US009526667B1

(12) United States Patent
Wang

(10) Patent No.: US 9,526,667 B1
(45) Date of Patent: Dec. 27, 2016

(54) TILTING INVERSION EXERCISER

(71) Applicant: Beto Engineering & Marketing Co., Ltd., Taichung (TW)

(72) Inventor: Lo Pin Wang, Taichung (TW)

(73) Assignee: Beto Engineering & Marketing Co., Ltd., Taichung (TW)

( * ) Notice: Subject to any disclaimer, the term of this patent is extended or adjusted under 35 U.S.C. 154(b) by 42 days.

(21) Appl. No.: 14/735,174

(22) Filed: Jun. 10, 2015

(51) Int. Cl.
*A61H 1/02* (2006.01)
*A63B 26/00* (2006.01)

(52) U.S. Cl.
CPC ..... *A61H 1/0229* (2013.01); *A63B 2208/0285* (2013.01)

(58) Field of Classification Search
CPC ..... A63B 2208/0285; A61H 1/0218–1/0229; A61H 2203/0493
See application file for complete search history.

(56) References Cited

U.S. PATENT DOCUMENTS 4,913,424 A * 4/1990 Pepin ..... A61H 1/0218 482/144
7,063,652 B1 6/2006 Teeter et al.
7,081,073 B1 7/2006 Smith
7,112,167 B2 9/2006 Kim
7,118,518 B1 10/2006 Teeter
7,125,372 B1 10/2006 Teeter et al.
7,374,521 B2 5/2008 Wang
7,507,192 B2 3/2009 Teeter et al.
7,544,157 B2 6/2009 Teeter et al.
7,585,264 B1 9/2009 Wang et al.
7,625,327 B1 12/2009 Teeter et al.
7,867,154 B2 1/2011 Teeter et al.
2007/0040078 A1* 2/2007 Wang ..... A61H 1/0218 248/144
2007/0265150 A1* 11/2007 Teeter ..... A61H 1/0218 482/145
2014/0371793 A1* 12/2014 Steffensmeier ..... A61H 1/0229 606/244
2015/0164730 A1* 6/2015 Chen ..... A61H 1/0222 482/144

* cited by examiner

*Primary Examiner* — Oren Ginsberg
*Assistant Examiner* — Jennifer M Deichl
(74) *Attorney, Agent, or Firm* — Charles E. Baxley

(57) ABSTRACT

A tilting inversion exerciser includes a supporting stand having a primary frame and an auxiliary frame, the primary frame includes two posts, two barrels on the posts, two shafts attached to the barrels, a carrier attached to the shafts for supporting a supporting table, and an actuator is coupled between one of the shafts and one of the posts and includes a release valve for releasing the actuator when the release valve is depressed and actuated, and for locking the actuator when the release valve is released. The user may easily actuate the release valve to release and to lock the actuator without applying much force or energy to rotate the carrier and the supporting table relative to the supporting stand.

14 Claims, 14 Drawing Sheets

TILTING INVERSION EXERCISER

BACKGROUND OF THE INVENTION

1. Field of the Invention

The present invention relates to a tilting inversion exerciser, and more particularly to a tilting inversion exerciser including an actuator for tilting the user supporting table to any selected angular position relative to the lower or base support or supporting stand without tilting the user supporting table by the user himself, and for supporting the user and for giving some security to the user while conducting the inversion exercises.

2. Description of the Prior Art

Various kinds of typical inversion suspension exercisers, rotational exercisers, tilting inversion exercisers etc. have been developed and comprise a user supporting table rotatably or pivotally attached to an upper portion of a lower or base support or supporting stand with a pivot axle, and rotatable relative to the base support for conducting or operating various inversion or suspension exercises.

For example, U.S. Pat. No. 7,081,073 to Smith, U.S. Pat. No. 7,118,518 to Teeter, U.S. Pat. No. 7,125,372 to Teeter et al., U.S. Pat. No. 7,585,264 to Wang et al., U.S. Pat. No. 7,625,327 to Teeter et al., and U.S. Pat. No. 7,867,154 to Teeter et al. disclose several of the typical inversion suspension exercisers each comprising a user supporting table rotatably or pivotally attached to a base support or supporting stand and arranged for allowing the users to rotate the table relative to the base support, and to do various inversion or suspension exercises.

However, the user has to spend a lot of force and energy to rotate and to hold and maintain the user supporting table at the selected angular position relative to the lower supporting stand, such that the user may not easily and comfortably actuate or operate the typical inversion suspension exerciser.

U.S. Pat. No. 7,063,652 to Teeter et al., U.S. Pat. No. 7,112,167 to Kim, U.S. Pat. No. 7,374,521 to Wang, U.S. Pat. No. 7,507,192 to Teeter et al., and U.S. Pat. No. 7,544,157 to Teeter et al. disclose the other typical inversion suspension exercisers each also comprising a user supporting table rotatably or pivotally attached to a base support or supporting stand, and a motorized mechanism attached to the supporting stand and coupled to the user supporting table for tilting the user supporting table to any selected angular position relative to the lower supporting stand and for allowing the users to easily and comfortably actuate or operate the typical inversion suspension exerciser.

However, the motorized mechanism of the typical inversion suspension exerciser is expensive and may not be easily and quickly made or manufactured by the workers, and/or may include a complicated making or manufacturing procedure, such that the typical inversion suspension exerciser may include a greatly increased manufacturing cost.

The present invention has arisen to mitigate and/or obviate the afore-described disadvantages of the conventional tilting inversion exercisers.

SUMMARY OF THE INVENTION

The primary objective of the present invention is to provide a tilting inversion exerciser including an actuator for tilting the user supporting table to any selected angular position relative to the lower or base support or supporting stand without tilting the user supporting table by the user himself, and for supporting the user and for giving some security to the user while conducting the inversion exercises.

The other objective of the present invention is to provide a tilting inversion exerciser including an improved structure or configuration arranged for allowing the tilting inversion exerciser to be easily actuated or operated by the user.

In accordance with one aspect of the invention, there is provided a tilting inversion exerciser comprising a supporting stand including a primary frame and an auxiliary frame pivotally coupled together to form an inverted V-shaped structure, the primary frame including a first post and a second post, and including a first barrel and a second barrel provided on the first and the second posts respectively, a first shaft and a second shaft rotatably attached to the first and the second barrels respectively, a carrier attached to the first and the second shafts and pivoted in concert with each other, a supporting table attached to the carrier and pivoted in concert with the carrier, and an actuator coupled between the first shaft and the first post, the actuator including a release valve for selectively releasing the actuator when the release valve is depressed and actuated, and for allowing the carrier and the supporting table to be pivoted or adjusted relative to the supporting stand by the actuator to any selected angular position, and for selectively locking the actuator when the release valve is released, and thus for preventing the carrier and the supporting table from being pivoted or adjusted relative to the supporting stand by the actuator. The user may easily actuate the release valve to release and to lock the actuator without applying much force or energy to rotate the carrier and the supporting table relative to the supporting stand.

The first post includes a space formed therein for receiving the actuator, and the first barrel includes a chamber formed therein and communicating with the space of the first post for receiving the first shaft. The actuator is coupled to the first shaft, and the actuator includes a piston rod slidably extendible out of the actuator and coupled to the first post for rotating the first shaft and the carrier relative to the first barrel.

The actuator is coupled to the first shaft directly or indirectly with a linking arm. The first shaft includes a shank attached thereto, and the actuator is coupled to the shank of the first shaft with a pivot pin, and the pivot pin is spaced from the first shaft for forming an eccentric structure. The actuator includes a bracket attached to the piston rod and coupled to the first post. The release valve is engaged in the piston rod for being selectively depressed or actuated by the lever.

An operating device may further be provided and includes a lever having a first end portion, and having a second end portion for selectively engaging with the release valve. The operating device includes a handle slidably attached to the first barrel and coupled to the first end portion of the lever for actuating the second end portion of the lever to selectively engage with the release valve and to selectively release or lock the actuator.

The first barrel includes a chamber formed therein and includes a passage formed therein and communicating with the chamber of the first barrel, a hood is engaged onto the first barrel and includes an aperture formed therein, and the handle includes a tongue engaged through the passage of the first barrel and the aperture of the hood and engaged into the chamber of the first barrel and pivotally coupled to the lever. The actuator includes a bracket attached to the piston rod and coupled to the first post, and includes a groove formed in the bracket for slidably engaging with the second end portion of the lever and for guiding the lever to move relative to the piston rod of the actuator.

The first barrel includes a chamber formed therein and includes a plate provided in the chamber of the first barrel, and the plate includes an opening formed therein for rotatably engaging with the first shaft. The first barrel includes a gasket engaged in the opening of the plate and engaged between the plate and the first shaft for allowing the first shaft to be smoothly rotated relative to the first barrel. The first shaft and the gasket are engaged with each other with a non-circular cross section engagement.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
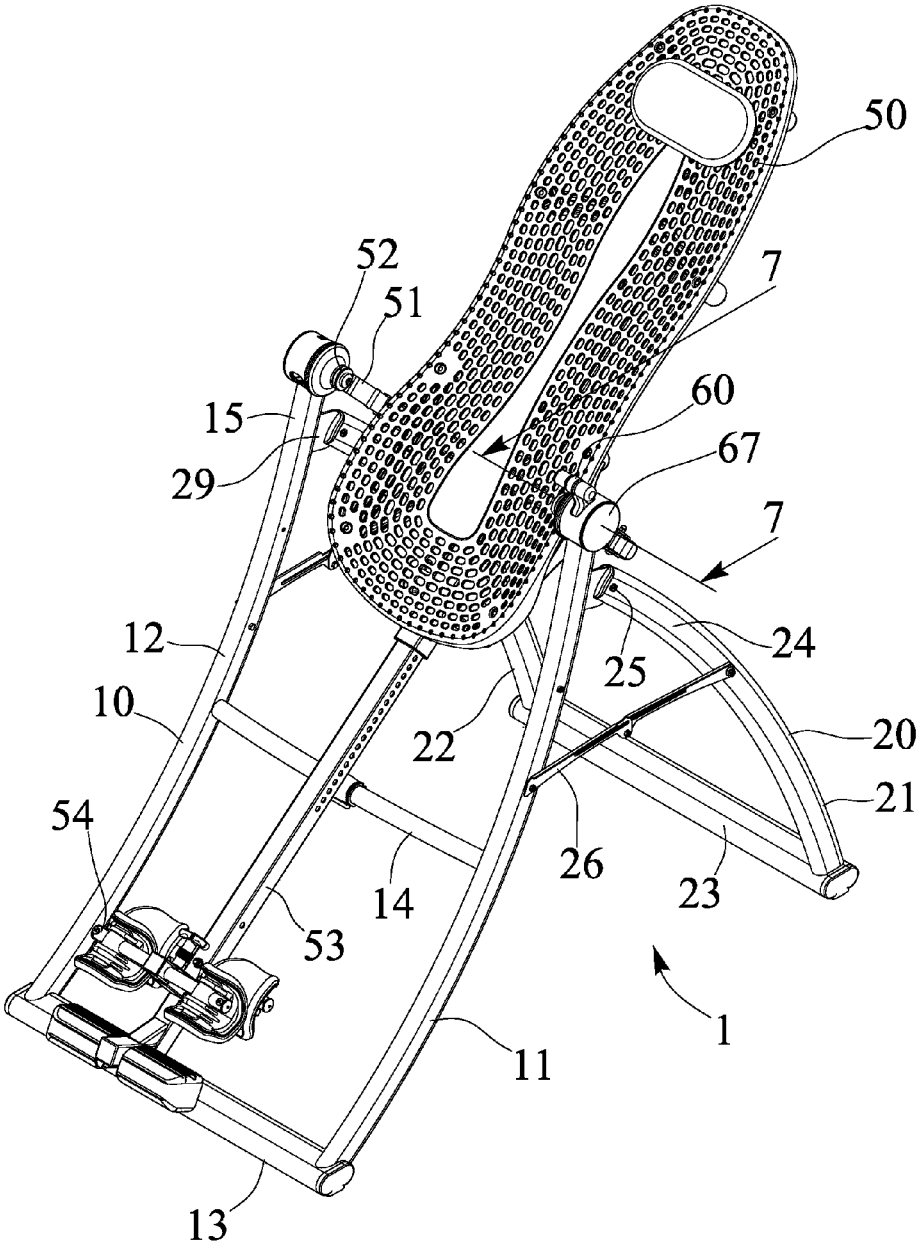
FIG. 1 is a perspective view of a tilting inversion exerciser in accordance with the present invention.
Figure 2:
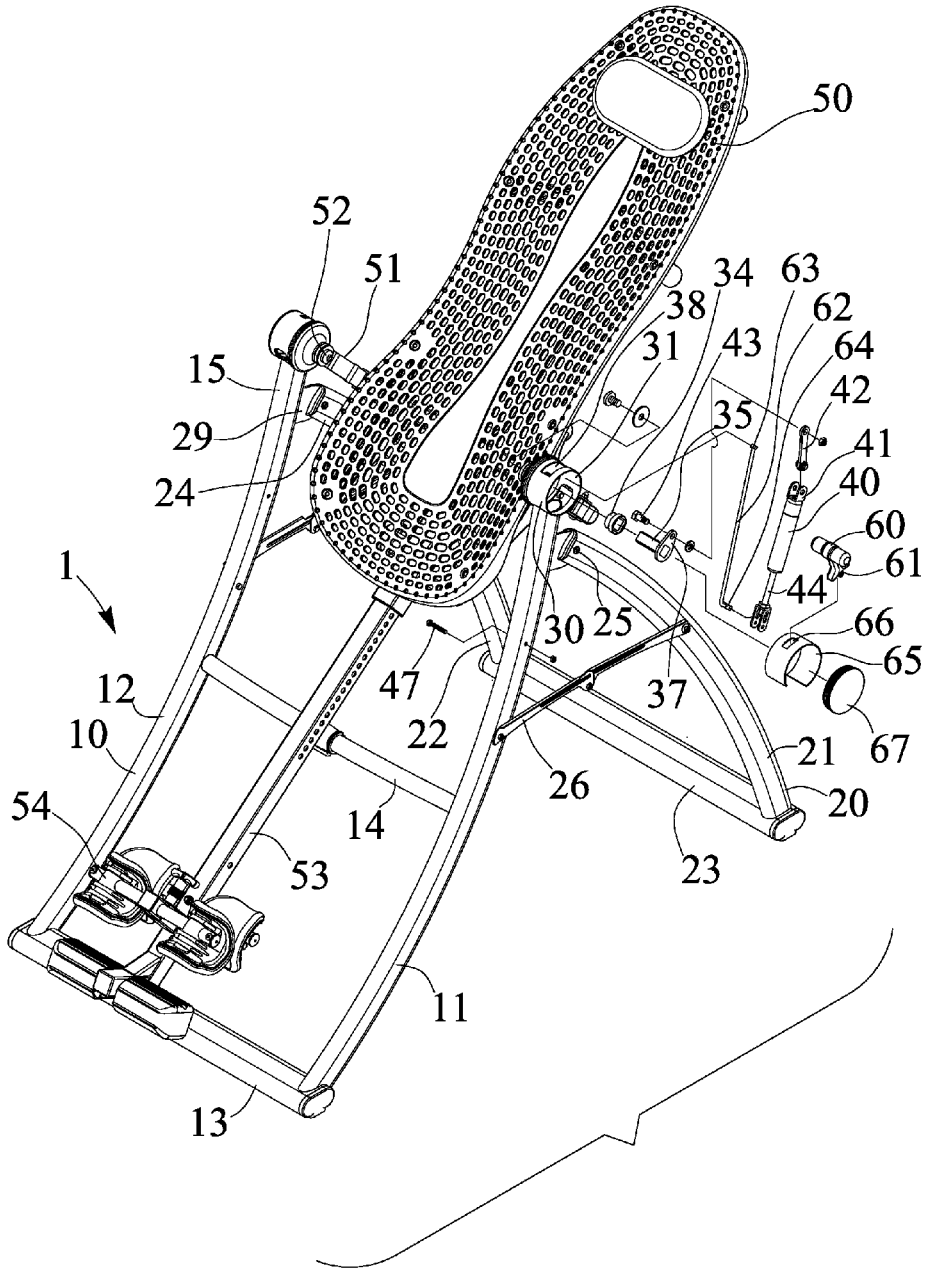
FIG. 2 is a partial exploded view of the tilting inversion exerciser.
Figure 4:
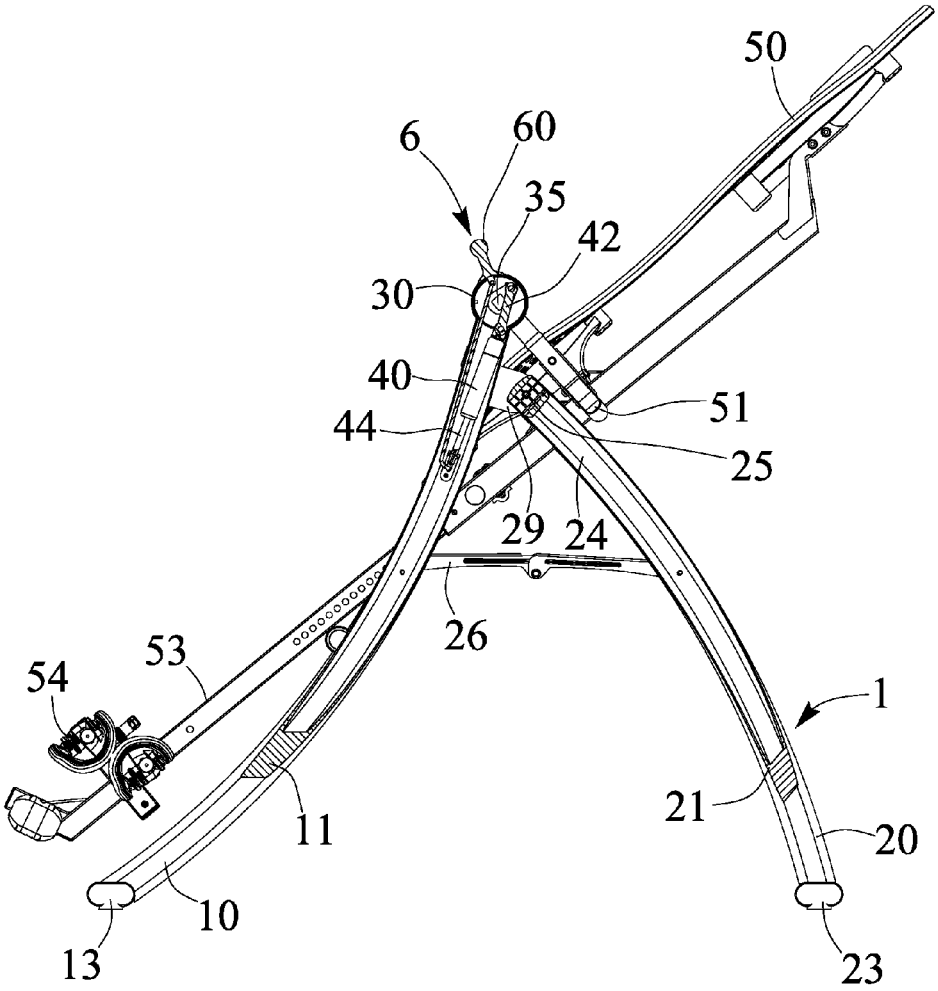
FIG. 4 is a side plan schematic view of the tilting inversion exerciser, in which a portion of the tilting inversion exerciser has been cut off for showing the inner structure of the tilting inversion exerciser.
Figure 5:
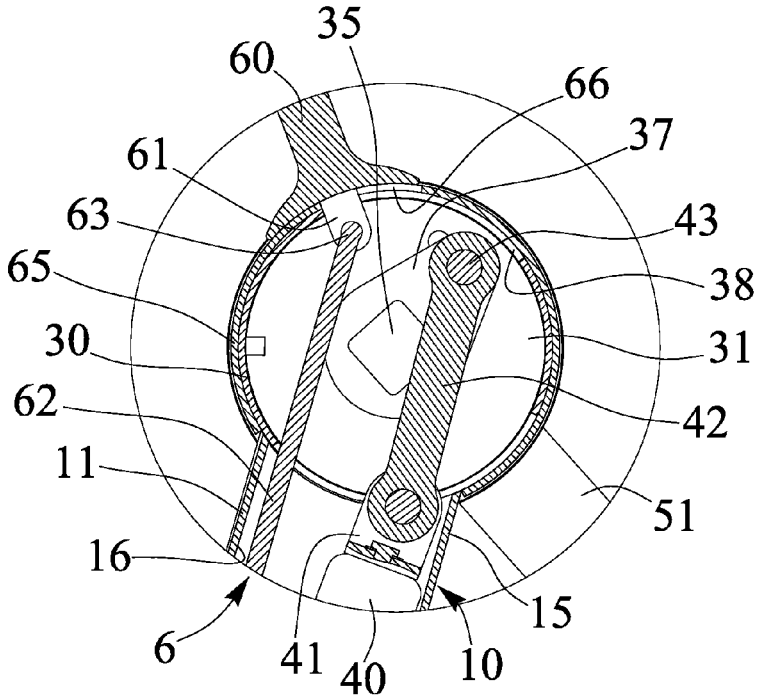
FIGS. 5, 6 are enlarged partial cross sectional views of the tilting inversion exerciser.

Referring to the drawings, and initially to FIGS. 1-2 and 4, a tilting inversion exerciser in accordance with the present invention comprises a lower supporting stand 1 for pivotally or rotatably supporting a base or table 50 thereon, and for supporting a user on the supporting table 50, the lower supporting stand 1 includes two U-shaped frames 10, 20, such as a front or primary U-shaped frame 10 and a rear or auxiliary U-shaped U-shaped frame 20 having upper ends pivotally coupled together with two apex members 29 so as to form a substantially inverted V-shaped structure (FIGS. 1-2, 4 and 8-10), and for allowing the frames 10, 20 of the supporting stand 1 to be folded and supported between an opened working position (FIGS. 1-2, 4 and 8-10) and a folded or compact storing position (not illustrated) wherein the frames 10, 20 of the supporting stand 1 are folded and contacted or engaged with each other.

The primary U-shaped frame 10 of the lower supporting stand 1 includes two, such as first and second side posts 11, 12 and a lower beam 13 formed or provided or coupled between the side posts 11, 12 for forming or defining the U-shaped structure of the primary frame 10, the apex members 29 are disposed or attached or mounted or secured to the upper portions 14 of the side posts 11, 12 of the primary frame 10 respectively. A bracket or carrier 51 is pivotally or rotatably attached or mounted or secured or coupled to the supporting stand 1 with a latch or bearing support or pivot joint or fastener 52, and located between the side posts 11, 12 for supporting or carrying the supporting table 50 and for pivotally or rotatably attaching or mounting or securing or coupling the supporting table 50 to the supporting stand 1 and for moving or adjusting the supporting table 50 relative to the supporting stand 1 to any selected angular position.

The rear U-shaped frame 20 also includes two side posts 21, 22 and a lower beam 23 formed or provided or coupled between the posts 21, 22 for forming or defining the U-shaped structure of the rear frame 20, the upper portions 24 of the posts 21, 22 of the rear frame 20 are pivotally or rotatably attached or mounted or secured or coupled to the upper portions 14 of the posts 11, 12 of the primary frame 10 or to the apex members 29 with pivot axles 25 respectively (FIG. 2) for allowing the rear frame 20 to be folded or moved toward the primary frame 10 to the folded or compact storing position, and to be opened or moved away from the primary frame 10 to the opened working position as shown in FIGS. 1-2, 4 and 8-10. One or more (such as two) foldable links 26 may further be provided and attached or mounted or secured or coupled between the frames 10, 20 for coupling the frames 10, 20 together and for solidly and stably anchoring or securing or retaining the frames 10, 20 at the opened working position and for preventing the frames 10, 20 from being over-opened relative to each other.

The supporting table 50 or the carrier 51 includes an extension 53, such as an adjustable extension 53 attached or coupled or extended from the supporting table 50 and/or the carrier 51 for supporting an ankle holder or foot retaining device 54 and for holding or retaining or positioning the feet of the user to the carrier 51 and the supporting table 50. The extension 53 may be extended or adjusted relative to the supporting table 50 for moving or adjusting the foot retaining device 54 toward or away from the supporting table 50, according to the height of the users, for example. The primary frame 10 further include a reinforcing bar 14 disposed or attached or mounted or secured between the posts 11, 12 of the primary frame 10 for reinforcing the primary frame 10, and for contacting or engaging with the extension 53 and for limiting the extension 53 and the supporting table 50 to pivot or rotate relative to the supporting stand 1.

The above-described structure or configuration for the tilting inversion exerciser, including the lower supporting stand 1, the carrier 51 and the extension 53 and the foot retaining device 54 and the supporting table 50 is typical and is not related to the present invention and will not be described in further details. The lower supporting stand 1 includes one or more, such as two cylindrical members or barrels 30, such as first and second barrels 30 are disposed or attached or mounted or secured on the upper portions 15 of the posts 11, 12 of the primary frame 10 respectively (FIGS. 2-5 and 7), and the barrels 30 each include a compartment or chamber 31 formed therein (FIGS. 2, 3), and at least one of the posts 11 of the primary frame 10 includes a bore or compartment or space 16 formed therein (FIG. 3), and formed in at least the upper portion 15 of one or first of the posts 11 and communicating with the chamber 31 of one of the barrels 30.

Figure 3:
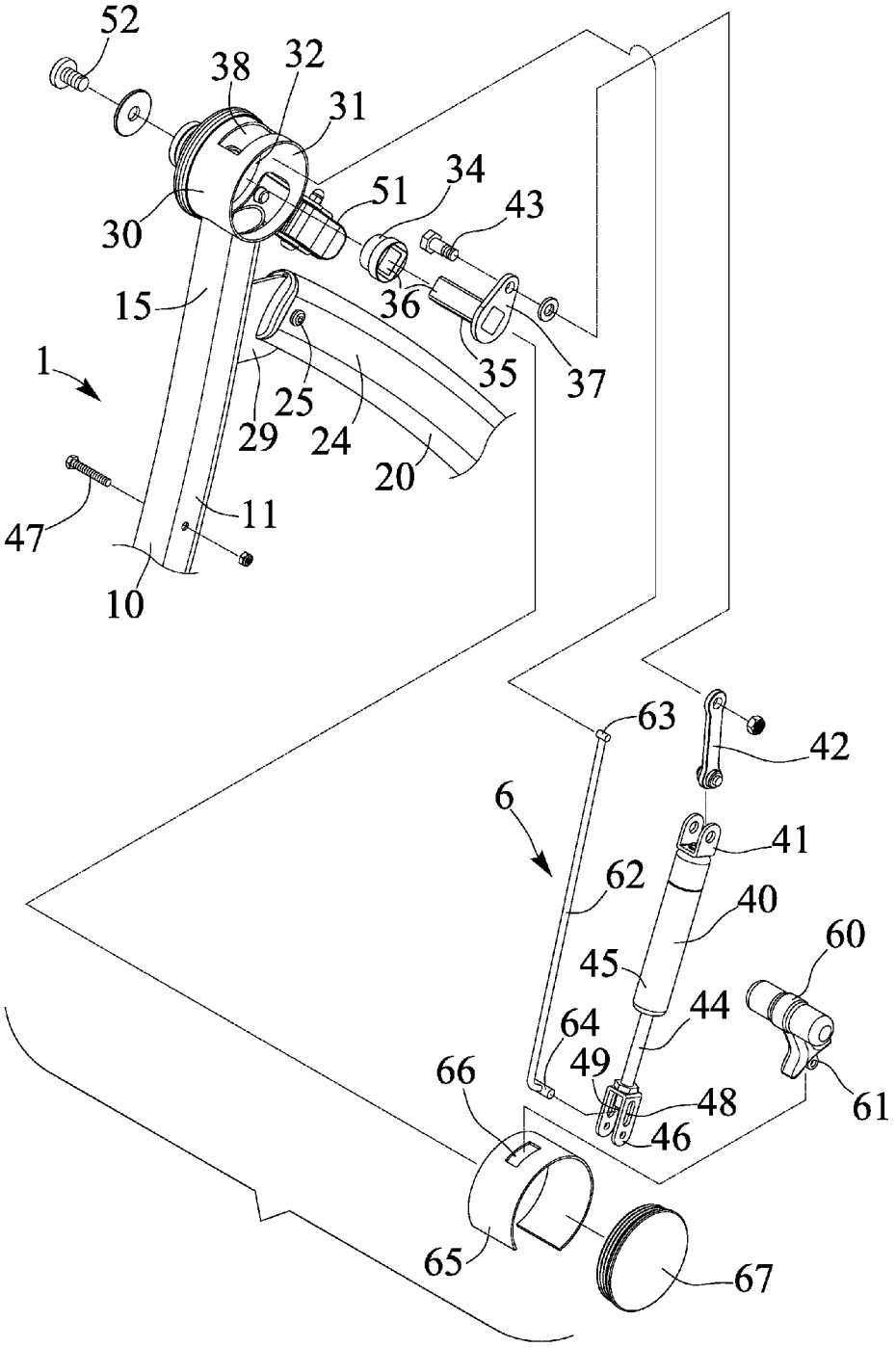
FIG. 3 is an enlarged partial exploded view of the tilting inversion exerciser.
Figure 7:
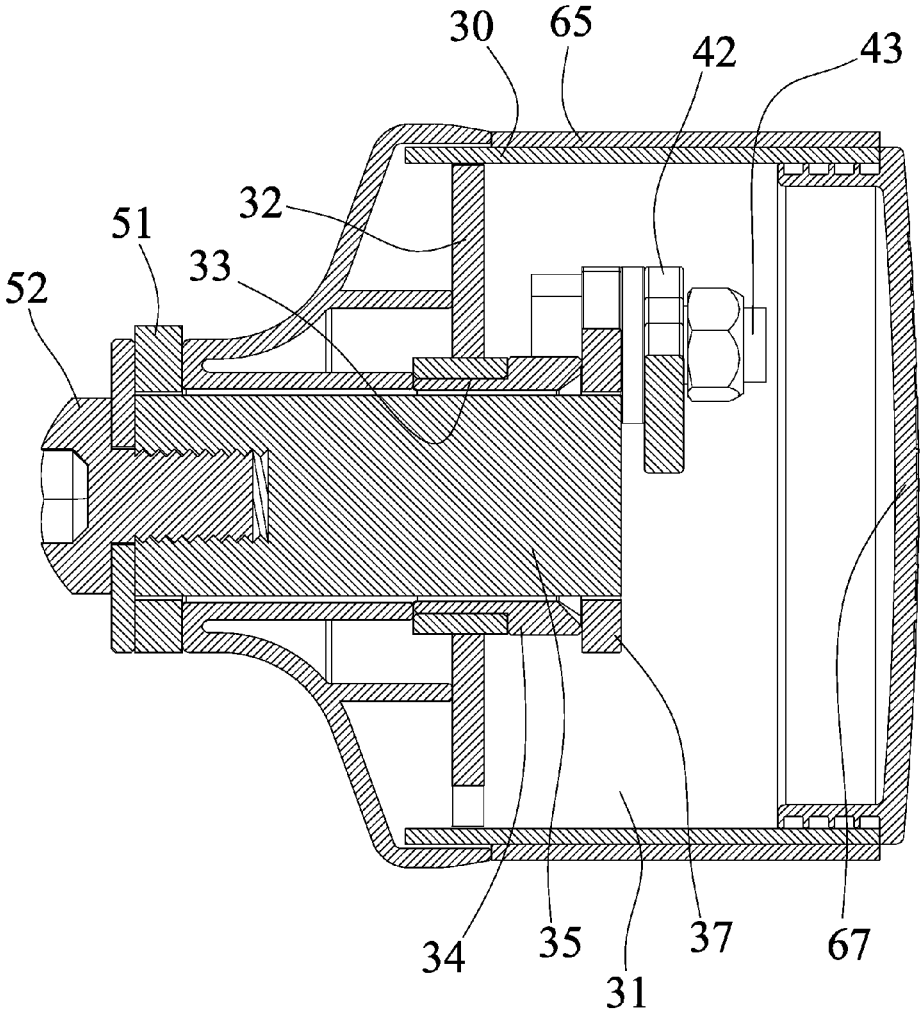
FIG. 7 is a cross sectional view of the tilting inversion exerciser, taken along lines 7-7 of FIG. 1.

As shown in FIGS. 3 and 7, the barrels 30 each include a partition or plate 32 formed or provided therein, and the plates 32 each include an opening 33 formed therein for pivotally or rotatably receiving or engaging with a bearing member or gasket 34 and a shaft 35 (FIGS. 2, 3), it is preferable, but not necessary that the gasket 34 and the shaft 35 are engaged with each other with a non-circular cross section engagement 36 for allowing the gasket 34 and the shaft 35 to be pivoted or rotated in concert with each other, and the gasket 34 is preferably disposed or engaged between the plate 32 and the shaft 35 for allowing the gasket 34 and the shaft 35 to be smoothly pivoted or rotated relative to the plate 32. As shown in FIGS. 2 and 3, the first and the second shafts 35 each include a non-circular cross section and attached or mounted or secured to the carrier 51 with the fastener 52 (FIG. 7) for allowing the gasket 34 and the shaft 35 and the carrier 51 to be pivoted or rotated in concert with each other.

The first shaft 35 includes a shank 37 attached thereto or extended radially and outwardly therefrom, and the one or first barrel 30 includes an oblong hole or passage 38 formed therein and communicating with the chamber 31 of the one or first barrel 30, and aligned with the space 16 of the post 11 of the primary frame 10 (FIG. 3) for allowing an actuator 40 to be selectively engaged through the passage 38 of the barrel 30 and to be selectively engaged into the space 16 of the post 11 of the primary frame 10 (FIGS. 4-5 and 8-10). The actuator 40 may be selected from a motor, hydraulic or pneumatic actuator 40 or the like, and includes one or first end portion 41 pivotally and indirectly secured or coupled to the first shaft 35 or the shank 37 with a linking arm 42 and a pivot pin 43, in which the pivot pin 43 is offset or spaced from the shaft 35 for allowing the shaft 35 and the carrier 51 to be pivoted or rotated relative to the primary frame 10 of the supporting stand 1 by the actuator 40.

Figure 8:
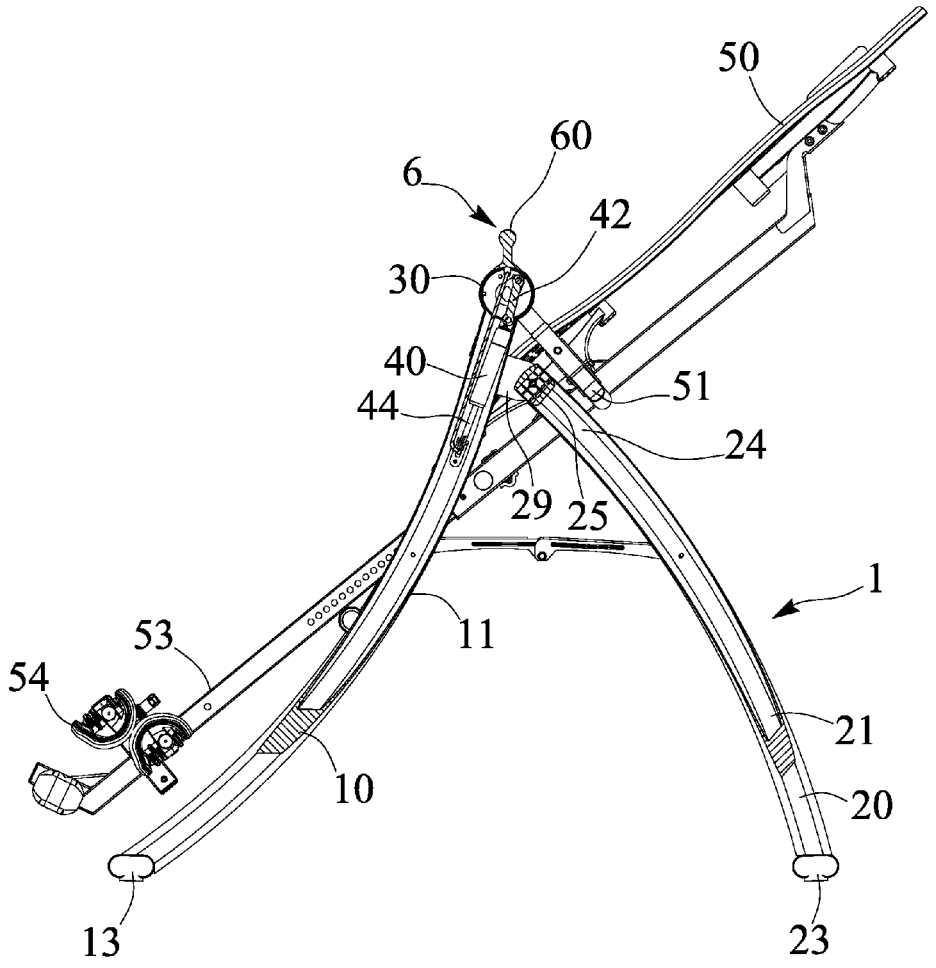
FIGS. 8, 9, 10 are side plan schematic views similar to FIG. 4, illustrating the operation of the tilting inversion exerciser.
Figure 9:
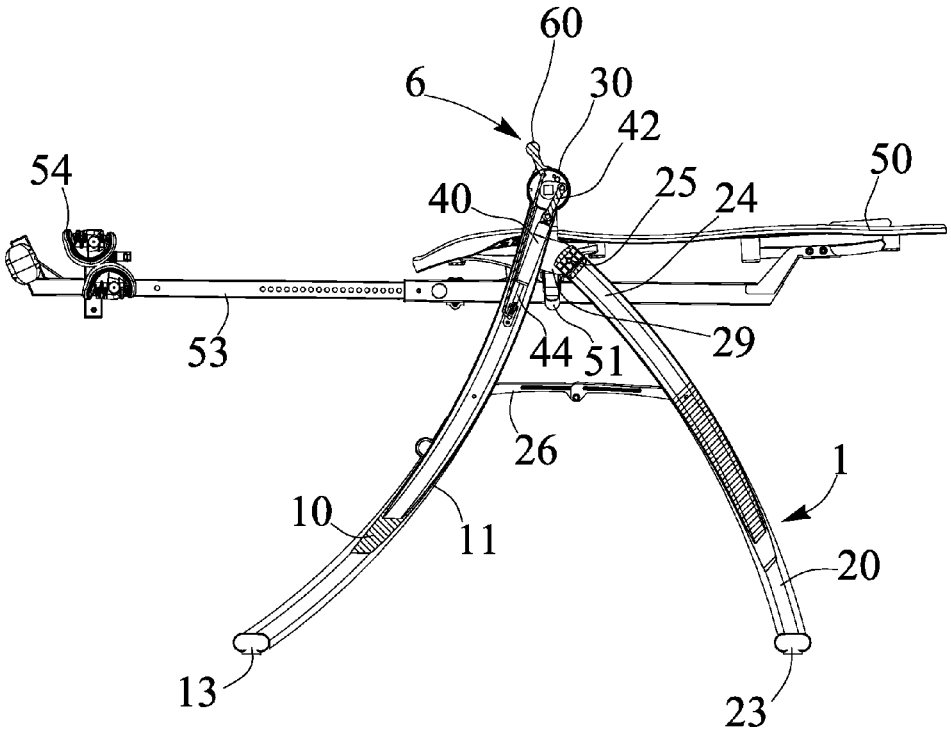
Figure 10:
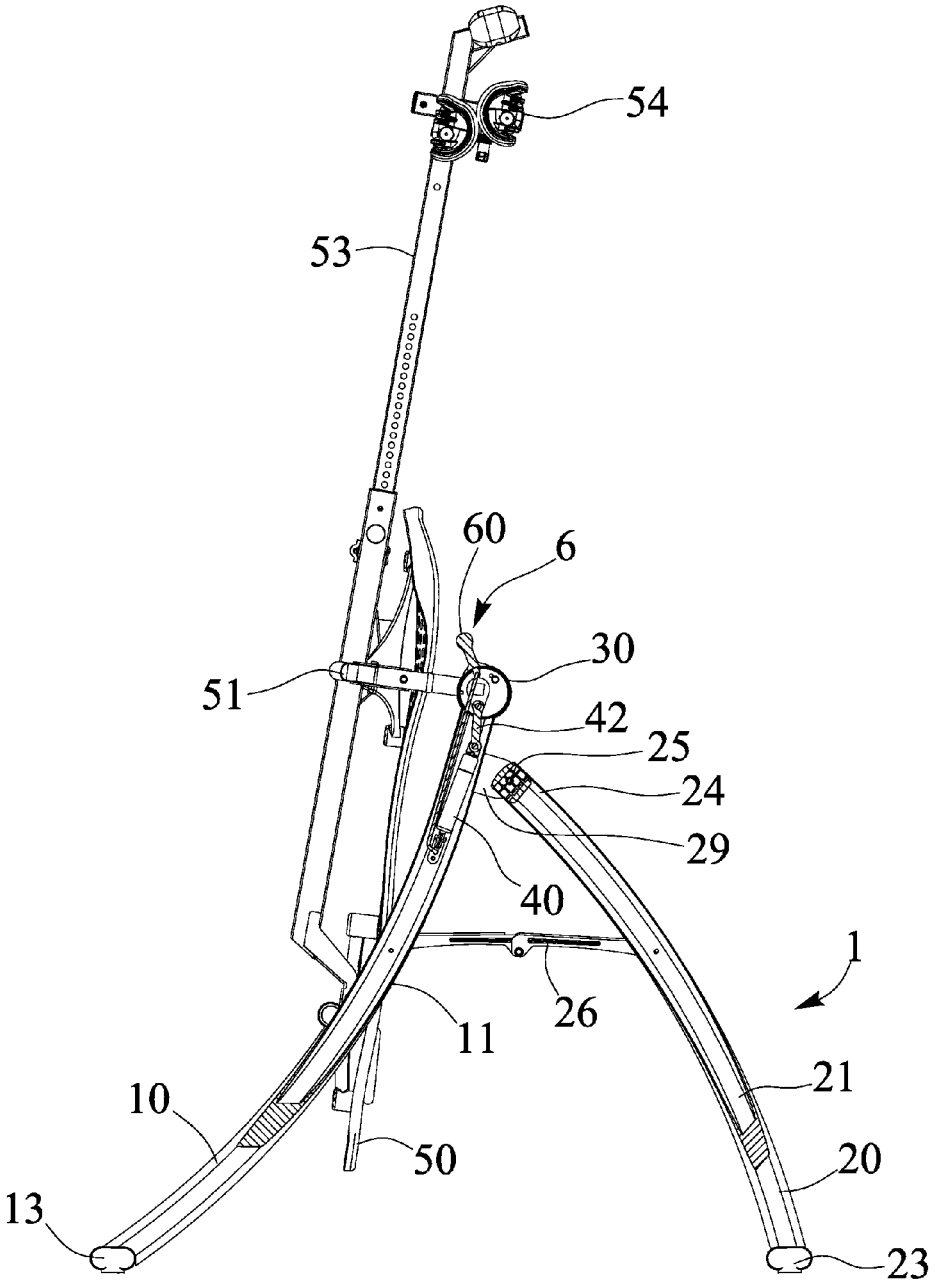

Alternatively, as shown in FIGS. 13-17, without the linking arm 42 the first end portion 41 of the actuator 40 may also be directly secured or coupled to the shank 37 with the pivot pin 43, in this situation, the shaft 35 and the carrier 51 may also be pivoted or rotated relative to the primary frame 10 of the supporting stand 1 by the actuator 40, such that the supporting table 50 may also be pivoted or rotated relative to the primary frame 10 of the supporting stand 1 by the actuator 40 to any selected angular position (FIGS. 8-10). The actuator 40 includes a piston rod 44 slidably extendible out of the other or second end portion 45 of the actuator 40, and includes an ear or bracket 46 attached or mounted or secured to the free end portion of the piston rod 44 and pivotally secured or coupled to the post 11 of the primary frame 10 with a latch or fastener 47 for allowing the actuator 40 to be coupled between the shaft 35 and the post 11 of the primary frame 10 and to be moved relative to the primary frame 10 of the supporting stand 1 by the piston rod 44 of the actuator 40.

Figure 6:
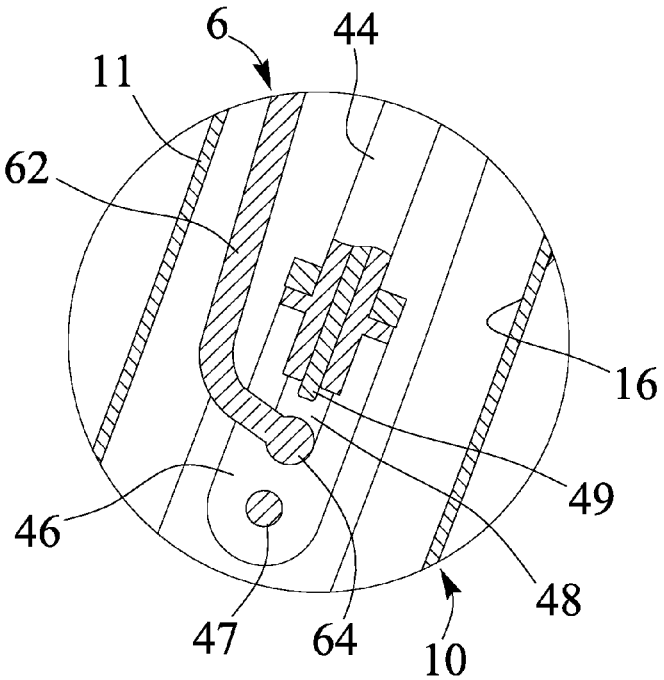
Figure 12:
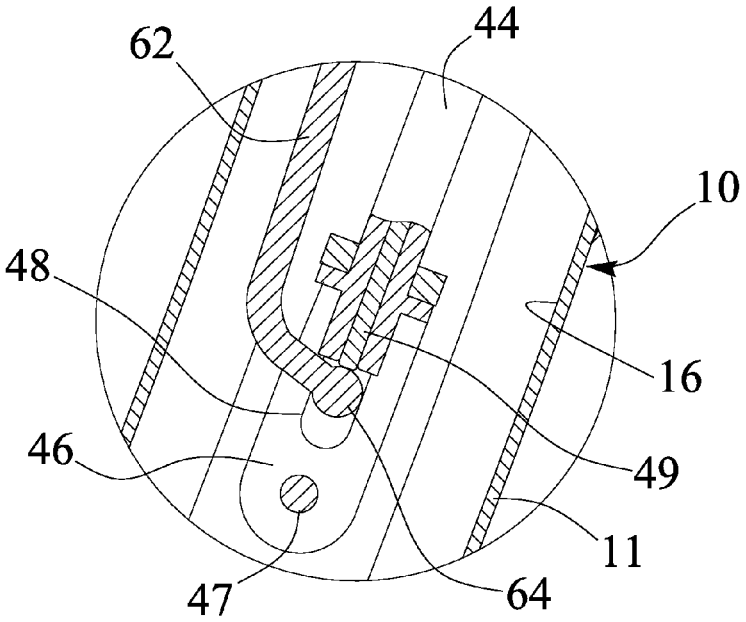
Figure 13:
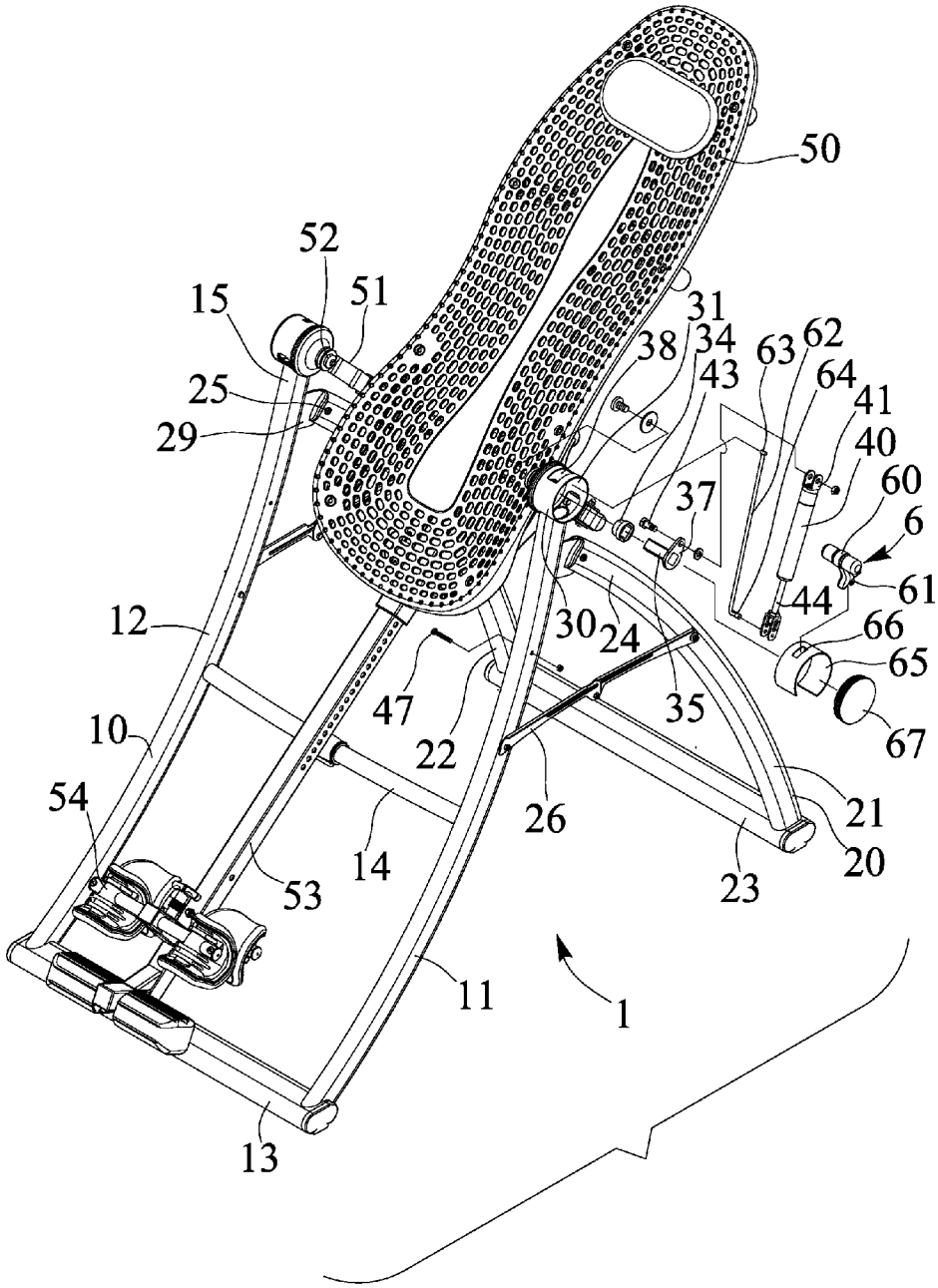
FIG. 13 is another partial exploded view similar to FIG. 2, illustrating the other arrangement of the tilting inversion exerciser.
Figure 14:
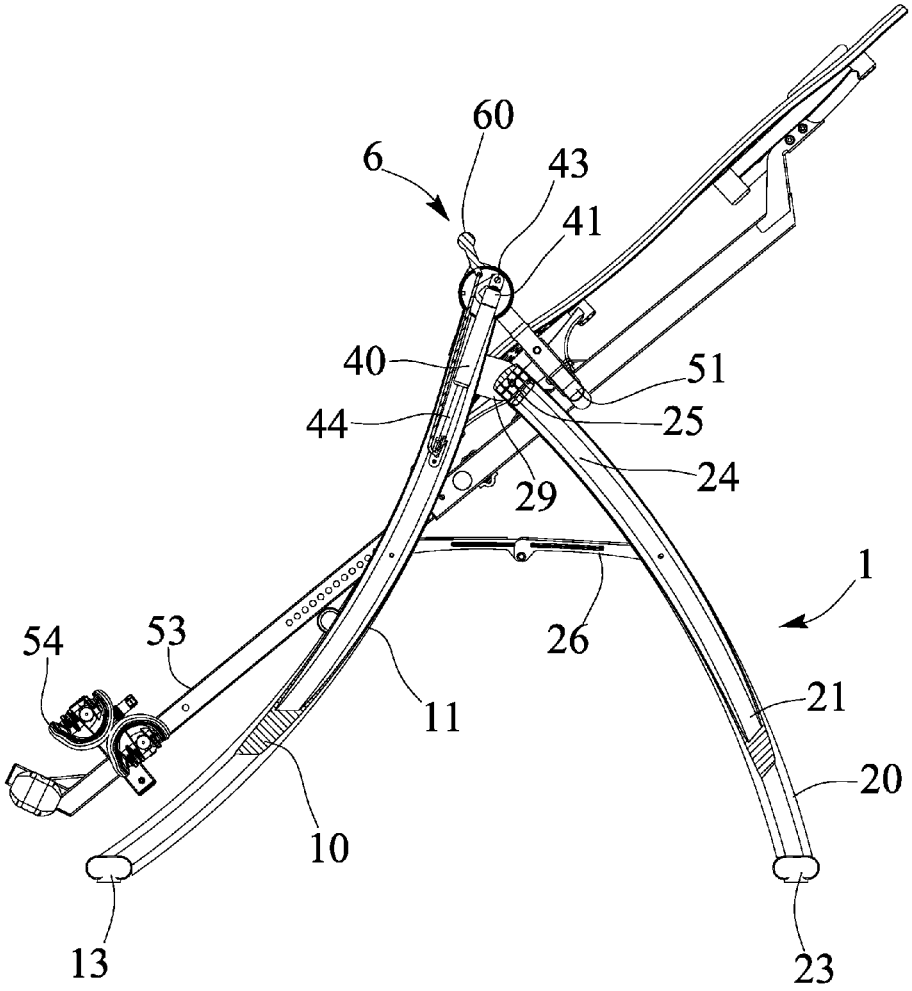
FIGS. 14, 15 are side plan schematic views illustrating the operation of the tilting inversion exerciser as shown in FIG. 13.
Figure 15:
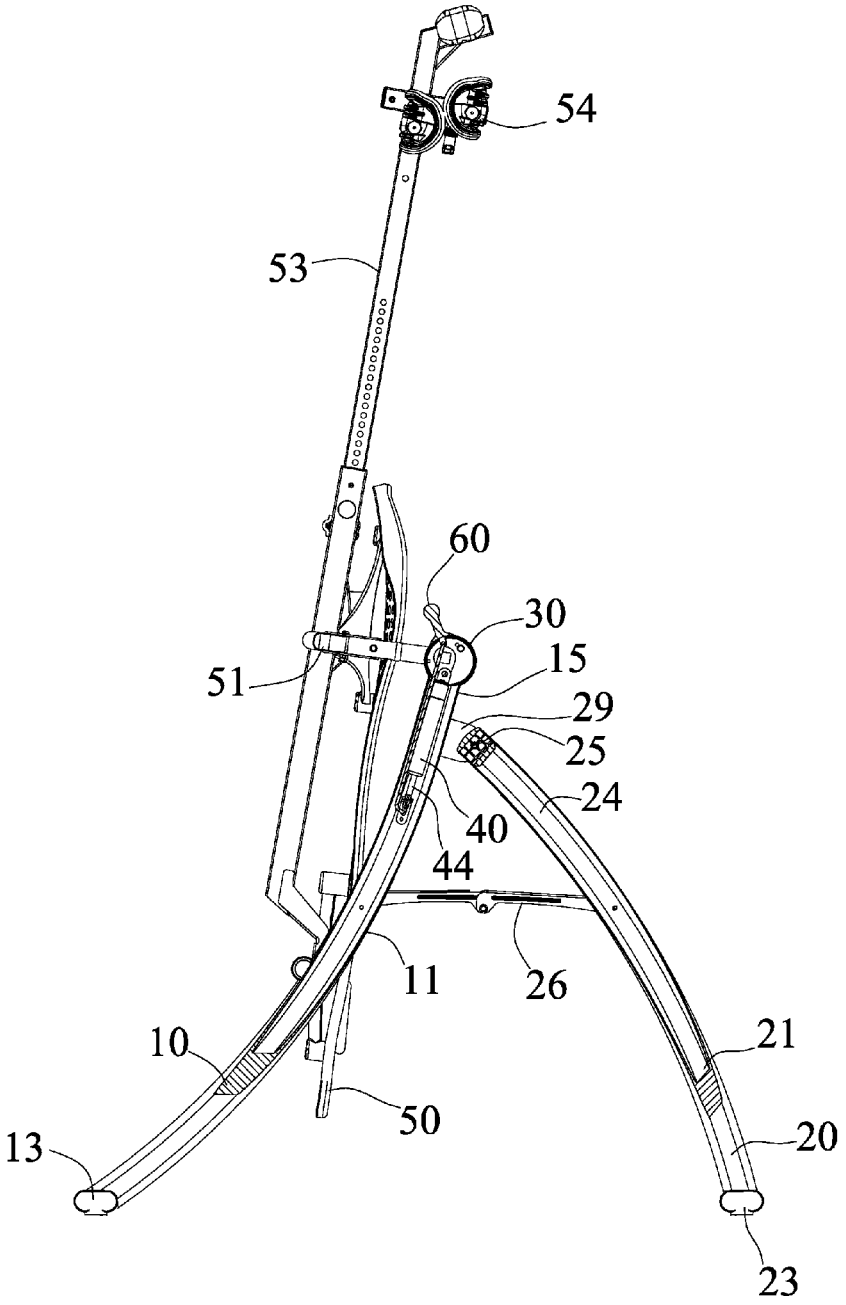
Figure 16:
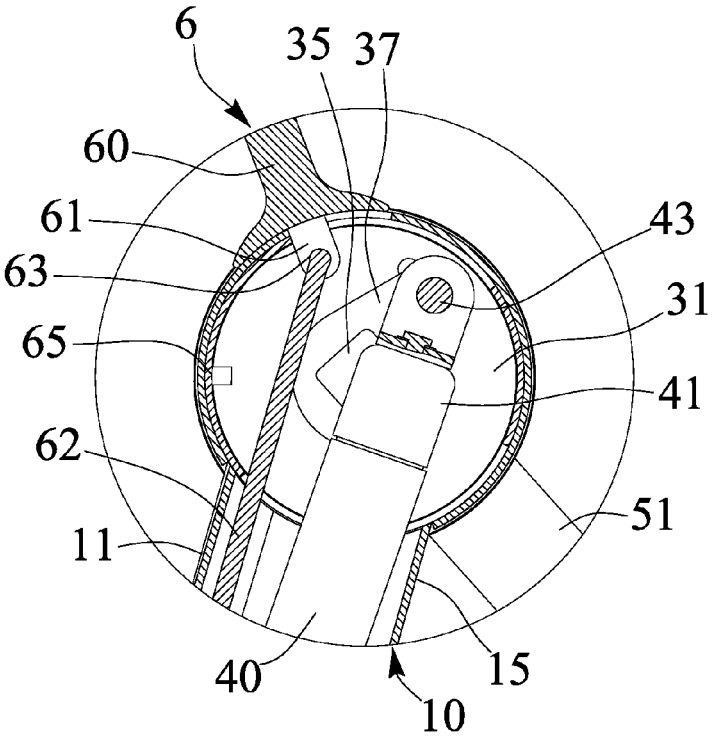
FIGS. 16, 17 are enlarged partial cross sectional views illustrating the operation of the tilting inversion exerciser as shown in FIGS. 13-15.
Figure 17:
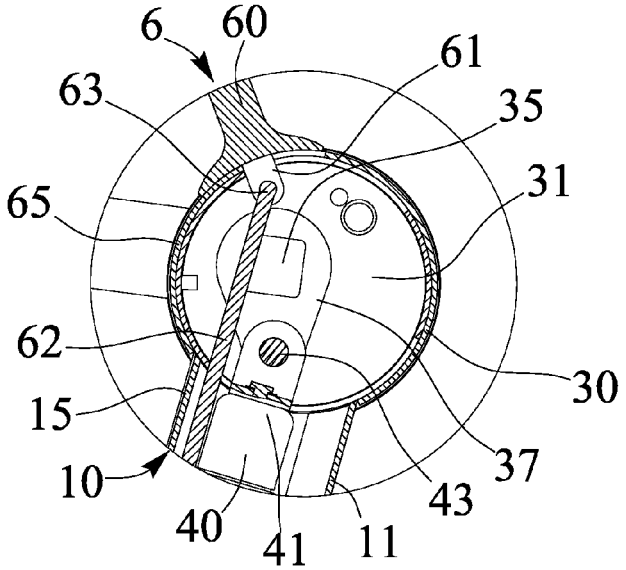

The bracket 46 includes one or more oblong holes or grooves 48 formed therein and substantially in line with or parallel to the piston rod 44, and the bracket 46 and/or the piston rod 44 may include a knob or switch button or release valve 49 slidably engaged therein, for example, as shown in FIGS. 3 and 6, the switch button or release valve 49 of the actuator 40 is slidably engaged in the piston rod 44 and extendible out of the piston rod 44, and extended or located beside or within the bracket 46, and the release valve 49 may be used for selectively or optionally releasing the actuator 40 and for allowing the piston rod 44 of the actuator 40 to be selectively moved relative to or into or out of the actuator 40 when the release valve 49 is depressed and actuated and forced into the piston rod 44 (FIG. 12) selectively, and the piston rod 44 may be locked and secured the actuator 40 and may not be moved relative to or into or out of the actuator 40 when the release valve 49 is released (FIG. 6).

Figure 11:
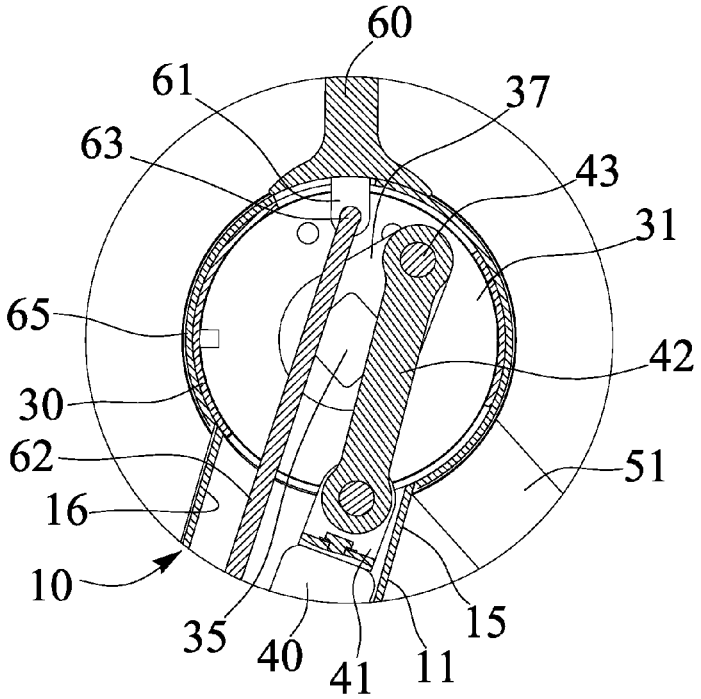
FIGS. 11, 12 are enlarged partial cross sectional views similar to FIGS. 5, 6 respectively, illustrating the operation of the tilting inversion exerciser.

An actuating or operating mechanism or device 6 may further be provided and includes a hand grip or handle 60 slidably attached or mounted or secured or engaged onto the barrel 30, and the handle 60 includes a tongue 61 extended downwardly therefrom and engaged through the passage 38 of the barrel 30 and engaged into the chamber 31 of the first barrel 30 (FIGS. 5, 11), a coupling or connecting rod or lever 62 includes one end portion 63 pivotally secured or coupled to the handle 60, such as coupled to the tongue 61 of the handle 60, another or second end portion 64 slidably engaged into or through either of the grooves 48 of the bracket 46 and/or into the bracket 46 for selectively or optionally contacting or engaging with the release valve 49 (FIG. 12), and for selectively releasing the release valve 49 (FIG. 6).

A cover or hood 65 may further be provided and slidably or rotatably attached or mounted or secured or engaged onto the barrel 30 and slidable or rotatable relative to the barrel 30, and includes an aperture 66 formed therein for slidably receiving or engaging with the tongue 61 of the handle 60, the aperture 66 of the hood 65 includes a size or dimension or standard or width or length equal to or slightly greater than that of the tongue 61 of the handle 60, for allowing only the tongue 61 to engage into the aperture 66 of the hood 65, and for preventing the handle 60 from engaging into the aperture 66 of the hood 65, and also for preventing the handle 60 from engaging into the chamber 31 of the first barrel 30. A cap or cover 67 may further be provided and attached or mounted or secured to the side portion of the barrel 30 for enclosing the barrel 30 and for covering and shielding the parts or elements contained in the barrel 30.

In operation, as shown in FIGS. 8-12, when the handle 60 is rotated in one direction, such as clockwise relative to the barrel 30 (FIG. 11), the lever 62 may be moved relative to the post 11 of the primary frame 10 with or by the handle 60, and the other or second end portion 64 of the lever 62 may be actuated or operated and forced to contact or engage with the release valve 49 (FIG. 12), in this situation, the shaft 35 and the carrier 51 and the supporting table 50 may be pivoted or rotated or adjusted relative to the primary frame 10 of the supporting stand 1 by the actuator 40 to any selected angular position (FIGS. 8-10). After the supporting table 50 has been pivoted or adjusted relative to the primary frame 10 of the supporting stand 1 to the selected or required angular position, the handle 60 may be rotated in the other or opposite direction, such as counterclockwise relative to the barrel 30 (FIG. 5), the lever 62 may be actuated and moved relative to the post 11 of the primary frame 10 with or by the handle 60, and the other or second end portion 64 of the lever 62 may be moved or disengaged from the release valve 49 (FIG. 6).

At this moment, the actuator 40 may no longer be actuated or operated, and the shaft 35 and the carrier 51 and the supporting table 50 may no longer be pivoted or rotated or adjusted relative to the primary frame 10 of the supporting stand 1. It is to be noted that the release valve 49 may be easily actuated or operated by the handle 60 and the lever 62, i.e., the user may spend less energy or force to move the handle 60 relative to the barrel 30, and the supporting table 50 may be pivoted or adjusted relative to the primary frame 10 of the supporting stand 1 by the actuator 40 to any selected angular position. It is further to be noted that the actuator 40 is preferably received or engaged or contained or shielded in the post 11 of the primary frame 10, however, the actuator 40 may also be disposed outside the post 11 of the primary frame 10 and coupled between the post 11 of the primary frame 10 and the carrier 51 and the supporting table 50.

Accordingly, the tilting inversion exerciser in accordance with the present invention includes an actuator for tilting the user supporting table to any selected angular position relative to the lower or base support or supporting stand without tilting the user supporting table by the user himself, and for supporting the user and for giving some security to the user while conducting the inversion exercises, and includes an improved structure or configuration arranged for allowing the tilting inversion exerciser to be easily actuated or operated by the user.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tilting inversion exerciser comprising:

a supporting stand including a primary frame and an auxiliary frame pivotally coupled together to form an inverted V-shaped structure, said primary frame including a first post and a second post, and including a first barrel and a second barrel provided on said first and said second posts respectively, a first shaft and a second shaft rotatably attached to said first and said second barrels respectively, a carrier attached to said first and said second shafts and pivoted in concert with each other, a supporting table attached to said carrier and pivoted in concert with said carrier, and an actuator coupled between said first shaft and said first post, said actuator including a release valve for selectively releasing said actuator when said release valve is depressed and actuated, and for selectively locking said actuator when said release valve is released.

2. The tilting inversion exerciser as claimed in claim 1, wherein said first post includes a space formed therein for receiving said actuator, and said first barrel includes a chamber formed therein and communicating with said space of said first post for receiving said first shaft.

3. The tilting inversion exerciser as claimed in claim 2, wherein said actuator is coupled to said first shaft, and said actuator includes a piston rod slidably extendible out of said actuator and coupled to said first post.

4. The tilting inversion exerciser as claimed in claim 3, wherein said actuator is coupled to said first shaft with a linking arm.

5. The tilting inversion exerciser as claimed in claim 3, wherein said first shaft includes a shank attached thereto, and said actuator is coupled to said shank of said first shaft with a pivot pin, and said pivot pin is spaced from said first shaft.

6. The tilting inversion exerciser as claimed in claim 3, wherein said actuator includes a bracket attached to said piston rod and coupled to said first post.

7. The tilting inversion exerciser as claimed in claim 3, wherein said release valve is engaged in said piston rod.

8. The tilting inversion exerciser as claimed in claim 1 further comprising an operating device including a lever having a first end portion, and having a second end portion for selectively engaging with said release valve.

9. The tilting inversion exerciser as claimed in claim 8, wherein said operating device includes a handle slidably attached to said first barrel and coupled to said lever for actuating said second end portion of said lever to selectively engage with said release valve.

10. The tilting inversion exerciser as claimed in claim 9, wherein said first barrel includes a chamber formed therein and includes a passage formed therein and communicating with said chamber of said first barrel, a hood is engaged onto said first barrel and includes an aperture formed therein, and said handle includes a tongue engaged through said passage of said first barrel and said aperture of said hood and engaged into said chamber of said first barrel and coupled to said lever.

11. The tilting inversion exerciser as claimed in claim 8, wherein said actuator includes a bracket attached to said piston rod and coupled to said first post, and includes a groove formed in said bracket for slidably engaging with said second end portion of said lever.

12. The tilting inversion exerciser as claimed in claim 1, wherein said first barrel includes a chamber formed therein and includes a plate provided in said chamber of said first barrel, and said plate includes an opening formed therein for rotatably engaging with said first shaft.

13. The tilting inversion exerciser as claimed in claim 12, wherein said first barrel includes a gasket engaged in said opening of said plate and engaged between said plate and said first shaft.

14. The tilting inversion exerciser as claimed in claim 13, wherein said first shaft and said gasket are engaged with each other with a non-circular cross section engagement.

* * * * *